US007089753B2

(12) United States Patent
Hoeks

(10) Patent No.: US 7,089,753 B2
(45) Date of Patent: Aug. 15, 2006

(54) COOLING MEMBER FOR A MOBILE ICE RINK AND METHOD FOR USING SUCH A COOLING MEMBER

(75) Inventor: Wilhelmus Adolfus Johannes Marie Hoeks, Baarn (NL)

(73) Assignee: Finhoeks B.V., Baarn (NL)

( * ) Notice: Subject to any disclaimer, the term of this patent is extended or adjusted under 35 U.S.C. 154(b) by 21 days.

(21) Appl. No.: 10/807,251

(22) Filed: Mar. 24, 2004

(65) Prior Publication Data

US 2005/0045318 A1 Mar. 3, 2005

(30) Foreign Application Priority Data

Mar. 24, 2003 (NL) ..... 1022998

(51) Int. Cl.
*F25C 3/02* (2006.01)

(52) U.S. Cl. ..... 62/235.1; 62/515

(58) Field of Classification Search ..... 62/235, 62/515–524; 165/77
See application file for complete search history.

(56) References Cited

U.S. PATENT DOCUMENTS 3,000,193 A * 9/1961 Crider ..... 62/285
4,611,471 A * 9/1986 Ohashi ..... 62/235
4,979,373 A * 12/1990 Huppee ..... 62/235
5,174,366 A * 12/1992 Nagakura et al. ..... 165/77
6,253,558 B1 * 7/2001 Stillwell et al. ..... 62/66
6,334,439 B1 * 1/2002 Specht et al. ..... 126/91 A

FOREIGN PATENT DOCUMENTS

| | | |
|---|---|---|
| EP | 1 031 809 | 8/2000 |
| FR | 2 502 896 | 10/1982 |
| FR | 2 677 262 | 12/1992 |
| FR | 2 802 292 | 6/2001 |
| GB | 252516 | 6/1926 |
| GB | 2 051 340 | 1/1981 |
| SU | 1 664 693 | 7/1991 |

* cited by examiner

*Primary Examiner*—William E Tapolcai
(74) *Attorney, Agent, or Firm*—Young & Thompson

(57) ABSTRACT

A cooling member for a mobile ice rink includes a feed manifold extending in a transverse direction and a discharge manifold, and a number of longitudinal pipes which extend transversely to the manifolds and can be connected at a first end to a manifold, two longitudinal pipes in fluid communication with one another at a second end via a connector, so that a fluid path is formed from the feed manifold to the discharge manifold via the two connected longitudinal pipes. In a transport position, the pipe sections are at an angle with respect to one another or are positioned on top of one another, and in an operational position the pipe sections extend in the extension of one another.

8 Claims, 10 Drawing Sheets

COOLING MEMBER FOR A MOBILE ICE RINK AND METHOD FOR USING SUCH A COOLING MEMBER

The invention relates to a cooling member for a mobile ice rink provided with:

a feed manifold extending in a transverse direction and a discharge manifold, and a number of longitudinal pipes which extend transversely to the manifolds and can be connected at a first end to a manifold, two longitudinal pipes in each case being in fluid communication with one another at a second end via a connector, so that a fluid path is formed from the feed manifold to the discharge manifold via the two connected longitudinal pipes.

The invention also relates to a system of longitudinal pipes for use in a cooling member, to an assembly of a feed manifold and a discharge manifold and to a method for assembling and for disassembling a mobile ice rink.

Such a pipe system for making a modular and mobile ice rink is known per se from FR 2 677 262, where parallel pipes are connected at one end via a U-shaped transverse pipe and are connected via flexible pipe sections to the feed manifold and discharge manifold. The known ice rink has the disadvantage that for installation and dismantling the components making up the ice rink always have to be separately assembled and disassembled, respectively. This makes the construction and dismantling of a system provided with such a known heat exchanger relatively laborious and therefore relatively time-consuming and expensive. Furthermore, leakage can occur when assembling the numerous separate components, which can severely delay completion of the rink. The known ice rink cannot be constructed with different surface areas in a relatively simple manner and furthermore has the disadvantage that the feed and discharge manifolds are installed in a relatively complex manner in a screened-off area located behind a barrier around the ice rink.

One aim of the present invention is to provide a cooling member for a mobile ice rink, which can be installed rapidly and such that it is reliable in operation. A further aim of the invention is to provide a cooling member for a mobile ice rink with which it is possible to proceed rapidly to the ice-forming stage. A further aim is to provide a cooling member with which a mobile ice rink can be made with a large number of different surface areas. A further aim is to provide a mobile ice rink where the coolant can be substantially or completely recovered.

To this end a cooling member according to the invention is characterised in that the cooling member comprises at least two elements, each with a feed manifold and discharge manifold and a number of longitudinal pipes connected thereto, wherein each longitudinal pipe comprises at least two rigid pipe sections that are connected to one another via a joint member such that they are fluid-tight, and wherein by moving the joint members a first series of parallel pipe sections can be placed in a transport position with respect to a second series of parallel pipe sections connected thereto, in which transport position the two series of pipe sections are at an angle with respect to one another or are positioned on top of one another, and can be placed in an operational position in which the two series of pipe sections extend in the extension of one another, wherein the first and the second element can be placed in the operational position alongside one another such that the feed and discharge manifolds of the elements extend in the extension of one another in the transverse direction, wherein the feed and discharge manifolds of the two elements are provided with a coupling member to make a fluid-tight connection between the respective feed and discharge manifolds of the first and the second element.

The cooling elements according to the invention can be delivered in the transport position, such as folded on top of one another. Before being transported, the pipe sections and the joint members, which, for example, can be constructed as flexible pipe sections, are pressure tested for fluid tightness at a test location. At the location of the ice rink the longitudinal pipes can be folded open and placed flat on the ground. The manifolds can be coupled to one another in the transverse direction and connected to a source of coolant. Because the longitudinal pipes have been connected to one another such that they are fluid-tight prior to assembly and retain their fluid tightness in the transport position, assembly of the ice rink can take place very rapidly. A desired length of the ice rink can be obtained by using a greater or smaller number of longitudinal pipe sections and joint members, whilst the desired width of the ice rink can be obtained by coupling the desired number of manifolds to one another.

It is pointed out that a foldable solar collector where a channel plate extends between two end manifolds is disclosed in GB-A 2 051 340. The channel plate is partially surrounded by a rigid frame and is able to bend at the positions where the channel plate protrudes beyond the frame. The feed and discharge manifolds of the heat exchanger are not equipped to circulate a coolant for cooling an environment. Furthermore, the known solar collector cannot easily be expanded in the longitudinal or transverse direction in order to cover a desired surface area.

A system of heating pipes that can be connected to one another such that they can hinge in order to facilitate easy transport is disclosed is U.S. Pat. No. 6,344,439. However, the hinge joint of the pipes is no longer fluid-tight in the transport position, whilst there is no provision for a flexible expansion of the surface area that is covered by the pipes by coupling additional pipes to one another in the longitudinal direction or in the transverse direction.

In one embodiment according to the invention, the connector is made up of a rigid connecting pipe that extends in the transverse direction, the two ends of the longitudinal pipes being connected to the rigid connecting pipe via a flexible pipe section. A single connecting pipe to which the longitudinal pipes are connected forms the return path for neighbouring longitudinal pipes and forms a single, relatively simple component by means of which fluid-tight connection of the longitudinal pipes is guaranteed.

In another embodiment the joint member is of at least partially elastic, or at any rate flexible, construction. By making the joint member flexible it is relatively easy to transform the extended configuration of the assembly into the compact configuration of the assembly and vice versa. In a particular preferred embodiment, the joint member is made of rubber, in particular ethylene propylene diene monomer (EPDM). EPDM is a synthetic rubber that usually is very suitable for use as a joint member since EPDM is relatively strong, durable and permanently elastic. Moreover, EPDM can be manipulated at relatively low temperatures (down to about −40° C.). In addition, EPDM has a relatively high chemical resistance and a relatively high elongation at break of approximately 400%.

Preferably, the longitudinal pipes are connected to the joint member some distance apart. Positioning the pipes some distance apart and connecting to the joint member in this way usually makes it easier for the assembly to swing, since there will be no friction between the successive longitudinal pipes during swinging of the assembly. In a particular preferred embodiment, an external diameter of each pipe is smaller than half of the spacing between the pipes. By allowing the spacing between the pipes to be at least twice the external diameter, the extent to which the assembly can be swung will be made even more flexible. Moreover, in this way it will be possible in a relatively simple manner to fold up the assembly completely into the relatively compact transport position.

Preferably, the joint member is provided with at least one mechanical joint. The mechanical joint can be of very diverse types. Preferably, the joint member is also provided with locking means for locking the joint in the use position and/or in the transport position. The joint member is also preferably provided with a valve closure or other similar closure so that when the pipes are swung with respect to one another the first medium is retained in the pipes concerned. In this way loss of the first medium contained in the pipes can be prevented or at least counteracted.

In a preferred embodiment the assembly is provided with a number n of pipes and a number (n−1) of joint members for connecting the n pipes to one another, where n is greater than two. The assembly is thus not restricted to two pipes but can be provided with several pipes, as a result of which the assembly can acquire a relatively long length.

In one embodiment the longitudinal pipes are held a distance apart by at least one spacer. In this way an ordered unit of longitudinal pipes is obtained with which the surface area/volume ratio has at least essentially already been determined in advance. In one embodiment, the spacer and the joint member are joined to one another and in particular are integrated with one another.

Preferably, the pipes are made of metal, in particular aluminium. Metal, in particular aluminium, has the property of conducting heat particularly well. Thus, by using pipes made of aluminium in combination with joint members that have the same thermal conductivity, such as aluminium joint members, uniform heat exchange can take place between the first medium and the second medium without weak spots being produced in the ice at the location of the joint members. Moreover, pipes made of metal are relatively durable, strong and inexpensive. In addition to the above-mentioned advantages, aluminium also has the advantage that this material has a relatively low density, as a result of which the relatively lightweight assembly can be transformed relatively easily from the use position into the transport position and vice versa.

In addition to a mobile cooling member, a system for creating an ice rink furthermore comprises a cooling unit connected thereto for cooling the coolant. The cooling unit can be of very diverse types, but preferably must make efficient use of space, be relatively quiet and have a low energy consumption.

In a preferred embodiment the coolant is glycol. Glycol is usually very suitable as a coolant and is cooled by the cooling unit to a temperature of between approximately −8° C. to approximately −25° C. before the (liquid) glycol is fed through the assembly.

A method for making an ice rink according to the invention comprises the following steps:

delivering a cooling member, the longitudinal pipes having been placed in a transport position, placing the cooling member in the operational position on a fluid-tight substrate, making a raised edge around the cooling member to form a basin, connecting the cooling member to a source of coolant, filling the basin with water, so that the cooling member is submerged in water, and freezing the water by cooling via the submerged cooling member.

Because assembly of the ice rink according to the invention can take place easily by unfolding the longitudinal transport pipes, the system of longitudinal pipes can be placed on a sheet without the risk of the sheet being damaged by fitters, for example. Consequently, an ice rink can be made in an effective manner by placing the cooling member on a sheet, after which a watertight basin can be formed around the pipes with the sheet by raising the peripheral edges of the sheet. The basin can then be filled with water and cooling can be started in order to freeze the water to give ice. This has the advantage that there is no need to wait until sunset, as is customary when making ice rinks that are made by spraying water onto the cooling element. Furthermore, the freezing layer of water above the cooling element at 0° C. forms a good buffer between the surroundings and cold pipes, the temperature of which is, for example, −10° C., and the temperature of the outside air is, for example, +5° C., so that all cold is used for ice formation and is not lost to the surroundings.

A barrier can be created in a rapid and operationally reliable manner by freezing vertical uprights into the ice in the basin. The construction of the feed and discharge manifolds and the connections to the longitudinal pipes is such that the manifolds can also be placed in the basin and can be frozen completely into the ice, so that the manifolds and connections are well protected and the users of the ice rink can walk easily over them via the ice.

After thawing the system, the jointed segments of the ice rink according to the invention make it possible for these to be lifted successively during disassembly from the horizontal flat position in the direction of the manifolds, so as to discharge all coolant liquid from the cooling member via the manifold. As a result coolant is prevented from passing into the environment and causing pollution and the cooling liquid can be re-used.

The invention will be explained with reference to non-limiting illustrative embodiments shown in the following figures. In the figures:

FIG. 1 shows a side view of part of a longitudinal pipe according to the invention in an extended use position, FIG. 2 shows a side view of the longitudinal pipe according to FIG. 1 in a compact transport position, FIG. 3 shows a side view of the longitudinal pipe according to FIG. 1 in another compact transport position, FIG. 4 shows a side view of part of a joint member according to the invention, FIG. 5 shows a side view of part of another joint member according to the invention, FIG. 6 shows an alternative embodiment of a joint member according to the invention in the form of a universal joint.

Figure 9:
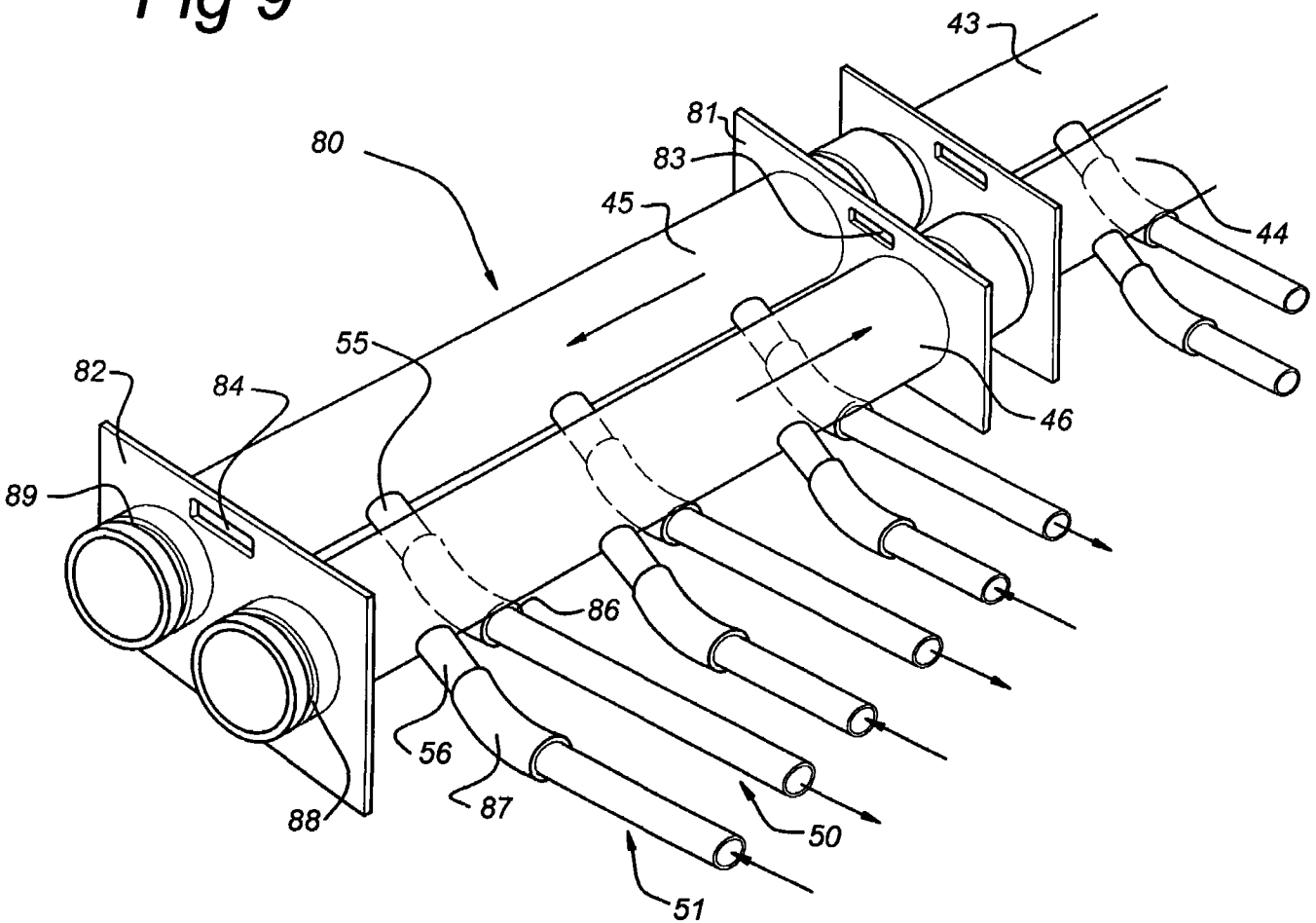
Figure 10:
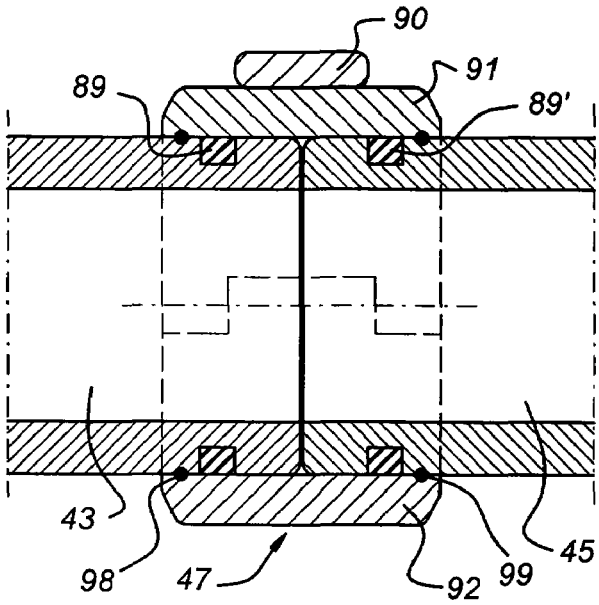
Figure 11:
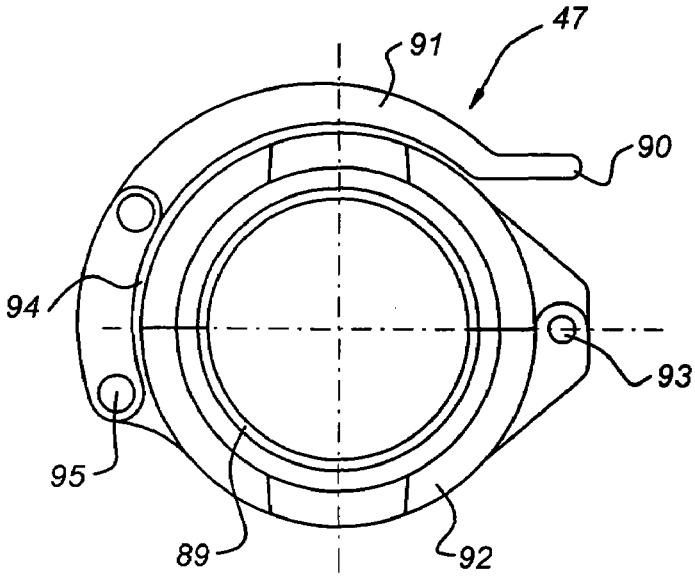
Figure 12:
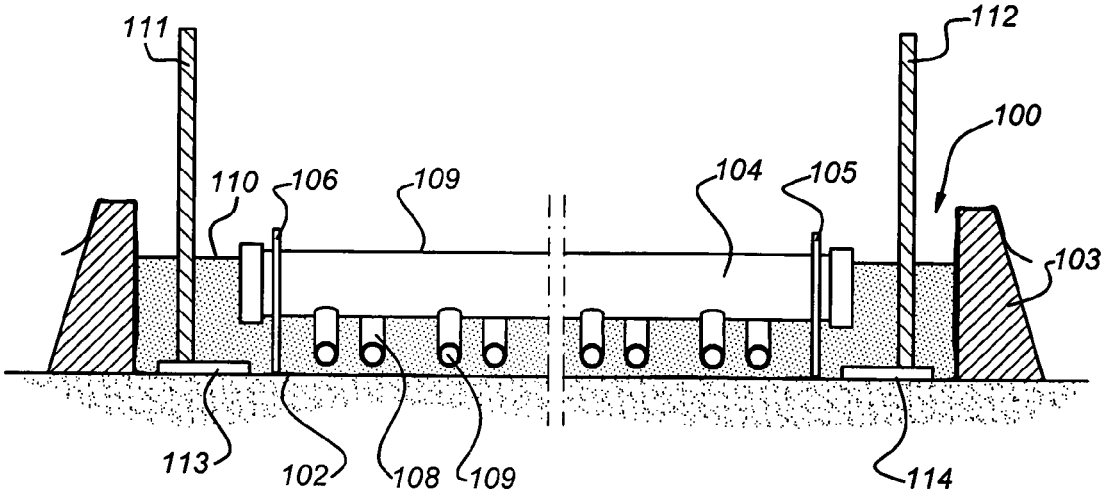
Figure 13:
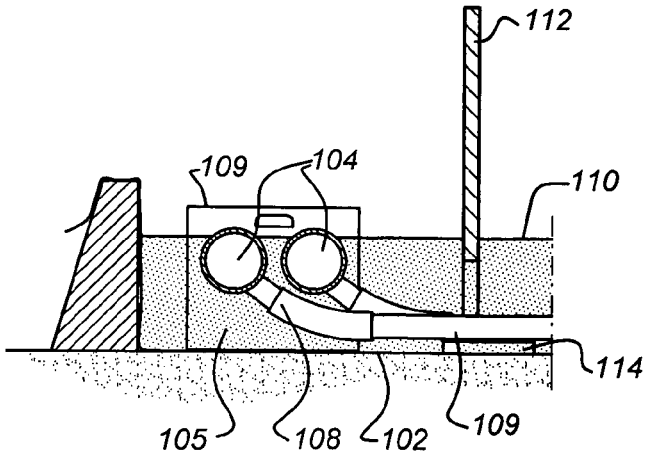
Figure 14A:
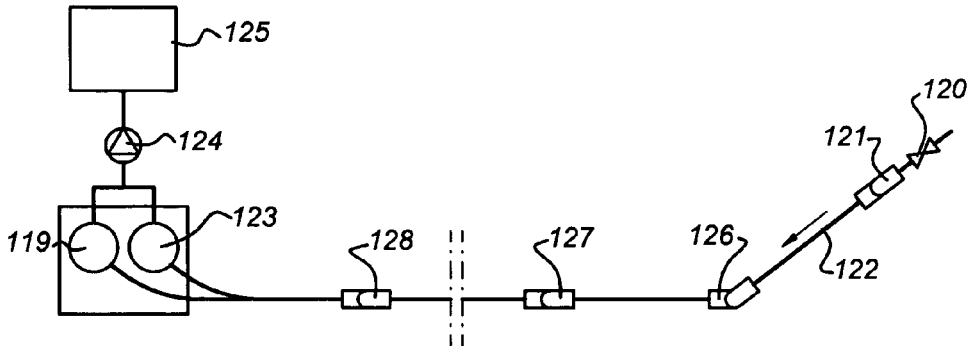
Figure 14B:
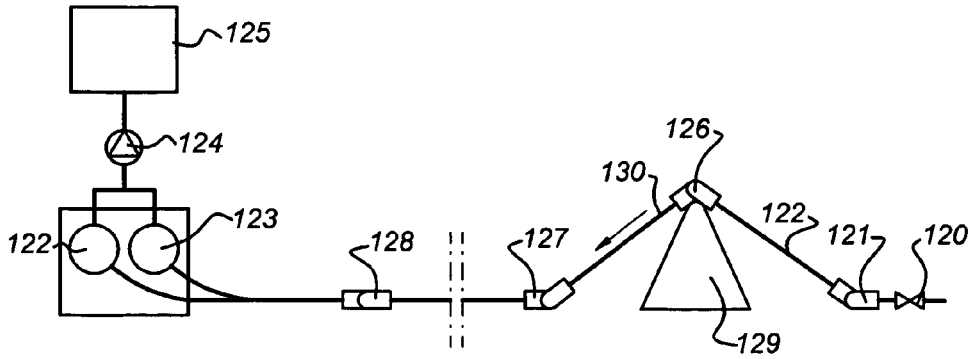

FIG. 9 shows a perspective view of a feed manifold and a discharge manifold that have been constructed as an integrated unit, FIG. 10 shows a longitudinal section of two manifolds joined to one another, FIG. 11 shows a side view of a coupling member for connecting the manifolds according to FIG. 9, FIG. 12 shows a cross-section through a basin with a cooling member according to the invention, FIG. 13 shows a side view of the position of the manifolds below the ice level in the basin according to FIG. 11, and FIGS. 14*a* and 14*b* show two successive steps in disassembling the mobile ice rink according to the invention before recovery of the coolant.

Figure 1:
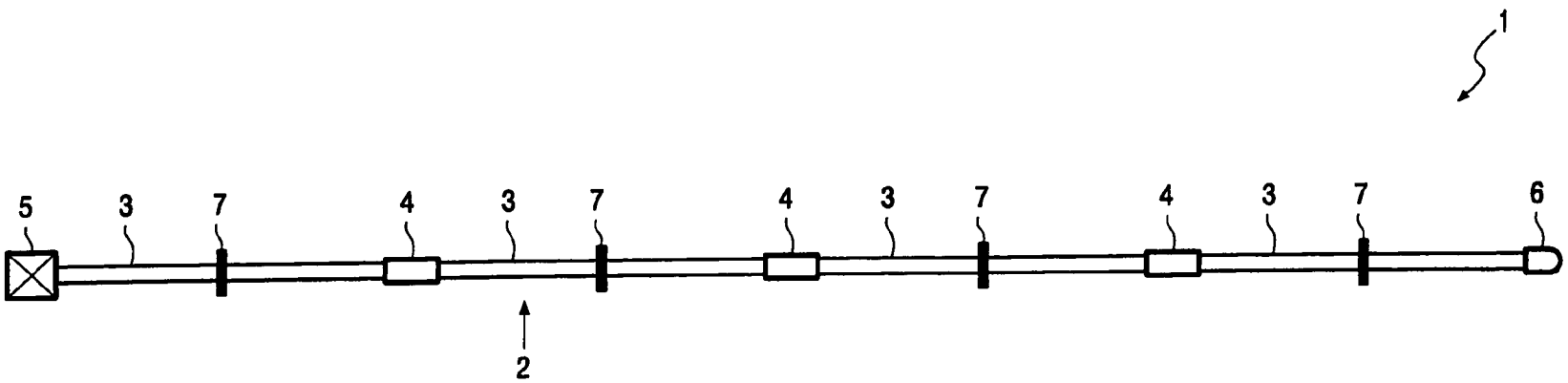

FIG. 1 shows a side view of part of longitudinal pipe 1 according to the invention in an extended use position. The part shown comprises several assemblies 2 of pipe sections 3 for a coolant that are connected together parallel to one another in the extension of one another by means of separate flexible hoses 4. Now only a single assembly 2 is shown. The assemblies 2 are coupled to one another by means of a manifold or collector 5 at one end and several transverse connectors 6 at the other end. The assemblies 2 are held a constant distance apart by means of several spacers 7 fitted around the assemblies 2. The longitudinal pipe 1, or at least part thereof, is now shown in a position ready for use, in which the coolant can be fed through the assemblies 2 and with which the surface area/volume ratio of the assemblies 2 is maximised.

Figure 2:
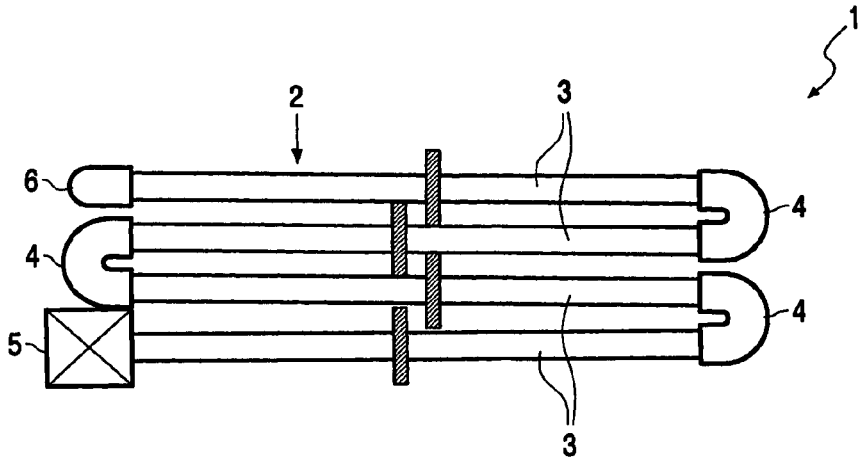

FIG. 2 shows a side view of the longitudinal pipe 1 according to FIG. 1 in a compact transport position. After the longitudinal pipe 1 has been used it no longer has to be (completely) disassembled, in contrast to the heat exchangers known from the state of the art. The flexible hoses 4 connecting pipes 3 now act as an element that allows swinging, as a result of which disassembly of the pipes 3 is no longer necessary because the extended position according to FIG. 1 can be transformed into a relatively compact transport position. The pipes 3 of the assemblies 2 are folded up in a zig-zag manner, as a result of which a compact construction is produced that is ready for storage and/or transport. With this arrangement the assemblies 2 can remain connected to one another by the collector 5 and the transverse connectors 6.

Figure 3:
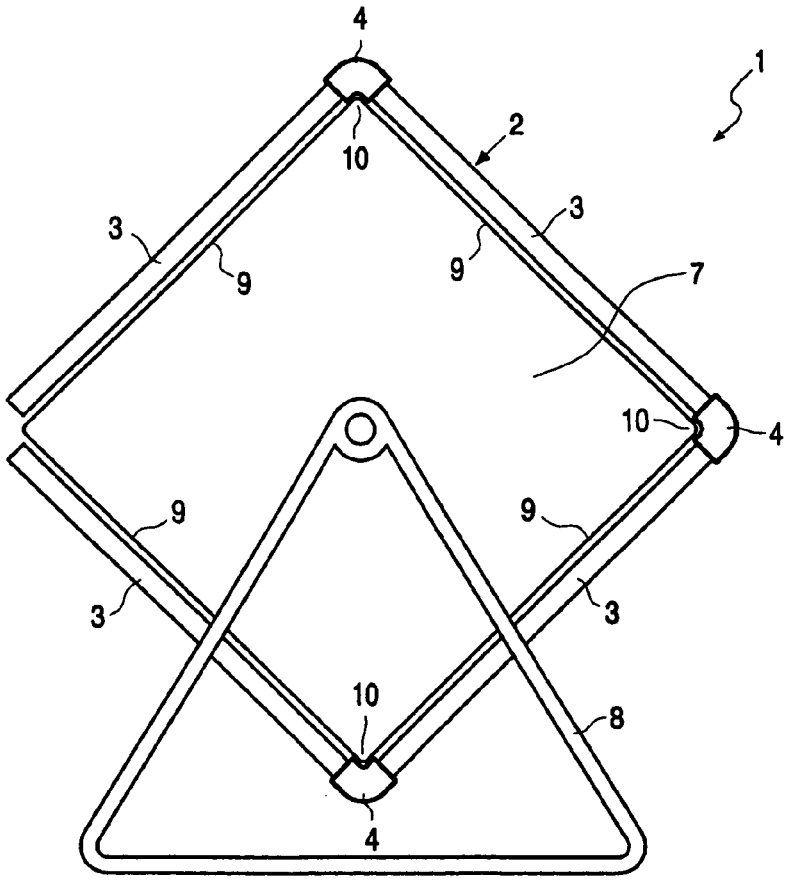

FIG. 3 shows a side view of part of a longitudinal pipe 1 according to FIG. 1 in another compact transport position. In contrast to the position shown in FIG. 2, the assemblies 2 have now been uncoupled from one another by removing the collector 5, the transverse connectors 6 and the spacers 7. Each assembly 2 is now wound up around a rotary beam 7', which beam 7' is supported by a supporting structure 8. As shown in the present illustrative embodiment, if each assembly 2 were to comprise several pipes 3 it would be conceivable to fit the assembly 2 in a helical manner around the rotary beam 7'. The length of each pipe 3 can now essentially correspond to the length of each of the sides 9 making up the beam 7', so that the flexible hoses 4 enclose three of the ribs 10 making up the beam 7'.

Figure 4:
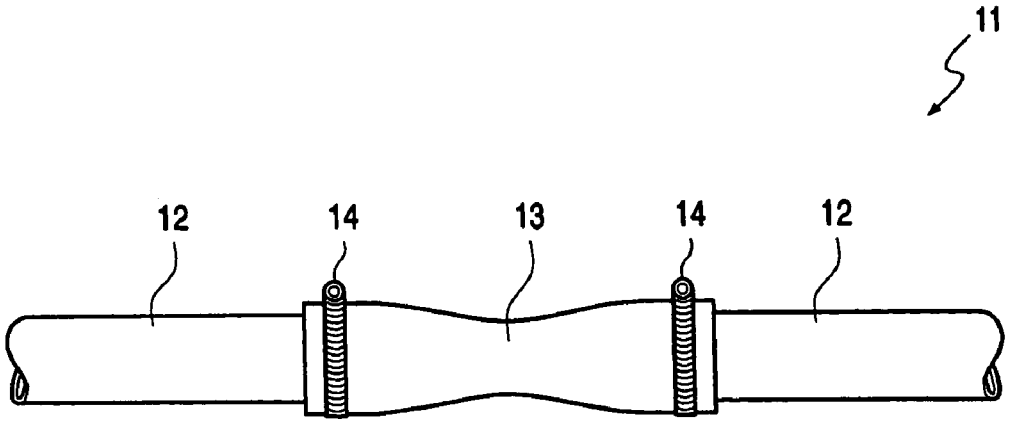

FIG. 4 shows a side view of part of an assembly 11 according to the invention. The assembly 11 comprises two pipes 12 for a cooling-fluid, in particular a liquid. The pipes 12 are positioned some distance apart but are connected to one another by a flexible hose 13. The hose 13 is preferably made of rubber, in particular of EPDM. The advantages of this synthetic rubber have already been described in detail above. An interior side of the hose 13 is stretched onto an external side of each of the pipes 12 so that it grips. In order to improve the fixing of the hose 13 to the pipes, (conventional) hose clips 14 can be fitted at either end of the hose 13. An adhesive can optionally additionally be applied between the hose 13 and the pipes 12. It should be clear that the pipes 12 can swing with respect to one another, as a result of which the assembly can be positioned in an extended position ready for use and a folded-up transport position.

Figure 5:
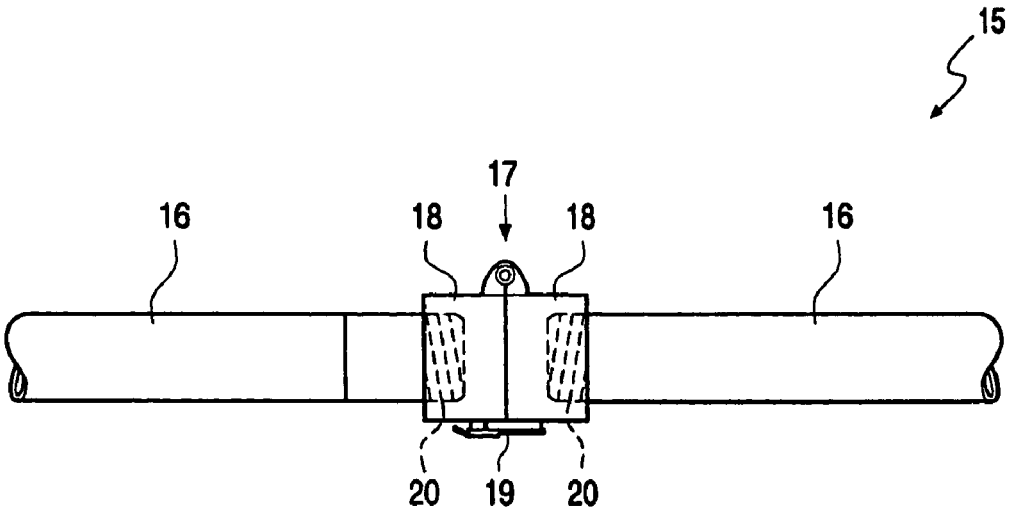

FIG. 5 shows a side view of part of another assembly 15 according to the invention. The assembly 15 now comprises two pipes 16 that are fixed to one another by means of a mechanical joint 17. The joint 17 comprises two joint parts 18 that can swing with respect to one another and locking means 19, joined to the joint parts 18, for locking the hinge 17 in an operational use position. The pipes 16 are connected to the hinge 17 by means of a screw joint 20 (shown in broken lines). The joint 17 can be provided with a valve mechanism, which is not shown, to prevent a fluid present in the pipes 16 leaking out. In addition, each joint part 18 can be provided with a seal surrounding the pipes 16 in order to counteract fluid leaks. It should be clear that the pipes 16 can swing with respect to one another and thus can be configured in a use position as shown or in a compact, folded-up transport position.

Figure 6:
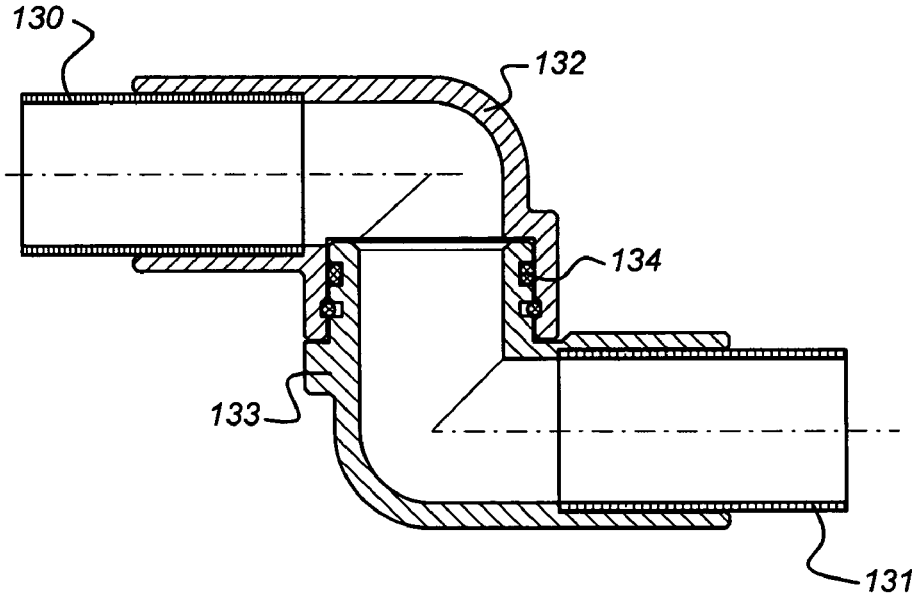

FIG. 6 shows, finally, a joint member according to the invention in the form of a universal joint by means of which pipe sections 130 and 131 are connected to one another. The universal joint comprises two right-angle bends 132, 133 that are connected to one another, via seals 134, such that they are able to rotate about an axis located transversely to the pipe sections 130, 131.

Figure 7:
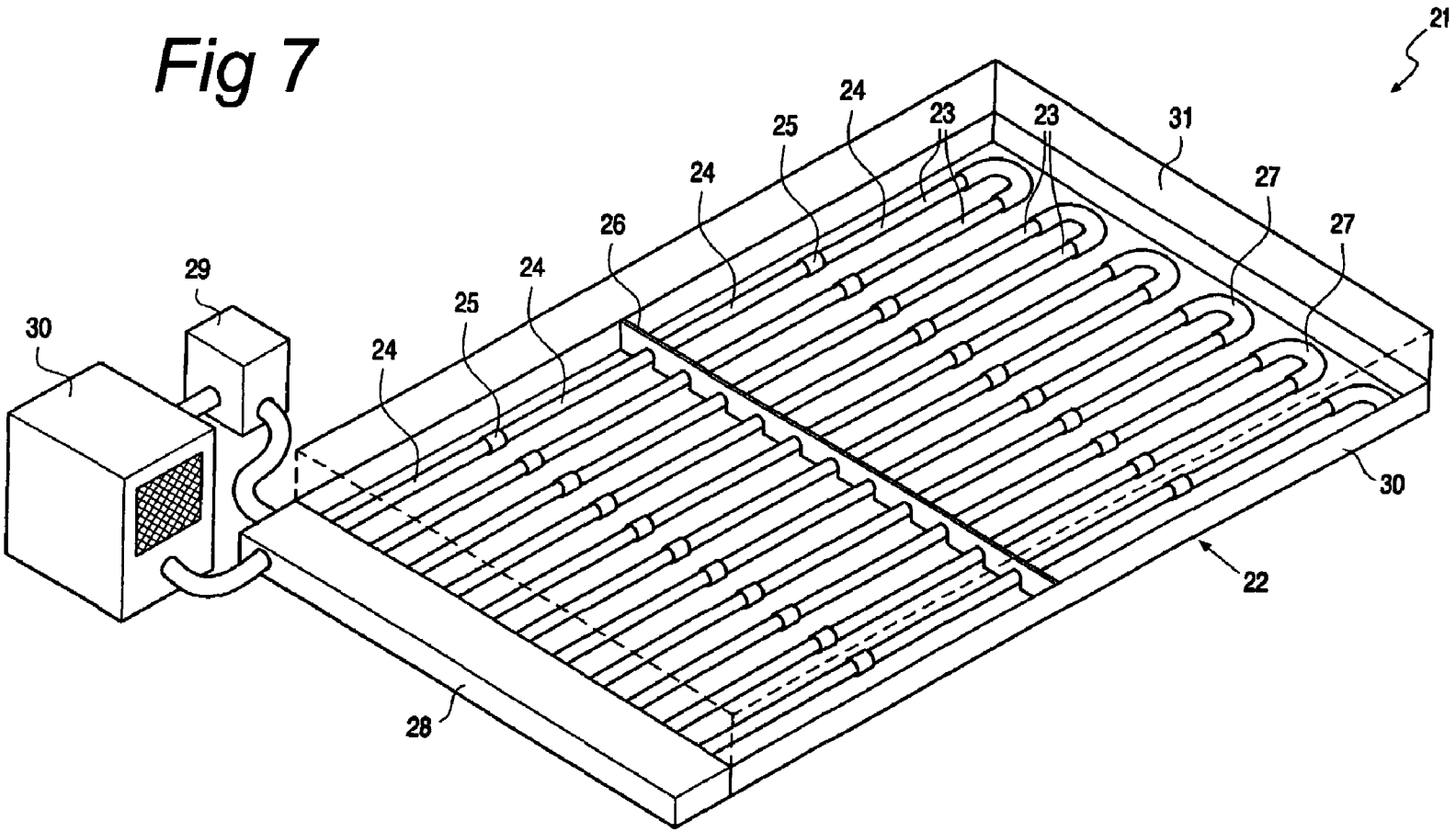
FIG. 7 shows a perspective view of a system for creating an ice rink in accordance with the invention.

FIG. 7 shows a perspective view of a system 21 for creating an ice rink in accordance with the invention. The system comprises a housing 22 for several assemblies 23 of pipes 24 and coupling elements 25 allowing swinging coupled to one another. Water is contained in the housing 22 (not shown). The assemblies 23 are kept a distance apart by a spacer 26. The construction and mode of operation of the assemblies 23 has already been discussed in more detail above. The pipes 24 preferably have a length of approximately 5 meters and an external diameter of approximately 19 millimeters. The distance between the pipes 24 is approximately 5 centimeters. At one end the assemblies 23 are coupled to one another by several transverse connectors 27 and at the other end are connected to two collectors 28. Glycol, which has been cooled to approximately −12° C. by a cooling unit 30, can be fed through the assemblies 23 with the aid of a pump 29 connected to one collector 28, as a result of which water contained in the housing 22 and surrounding the assemblies 23 will freeze with the formation of the ice rink. Preferably, the pipes 24 are positioned (some) distance away from the housing 22, so that the water can completely surround the pipes 24 on all sides. The housing 22 has a medium-tight substructure 30 for containing the water and a raised border 31, screening the ice rink, joined to substructure 30. After use of the ice rink, the assemblies 23 can be transformed easily and rapidly into a relatively compact transport position, after which the folded-up unit of assemblies 23 can then be transported. As a result of the use of the system 21 according to the invention, labour-intensive and time-consuming disassembly of separate components of the system is therefore no longer necessary.

Figure 8:
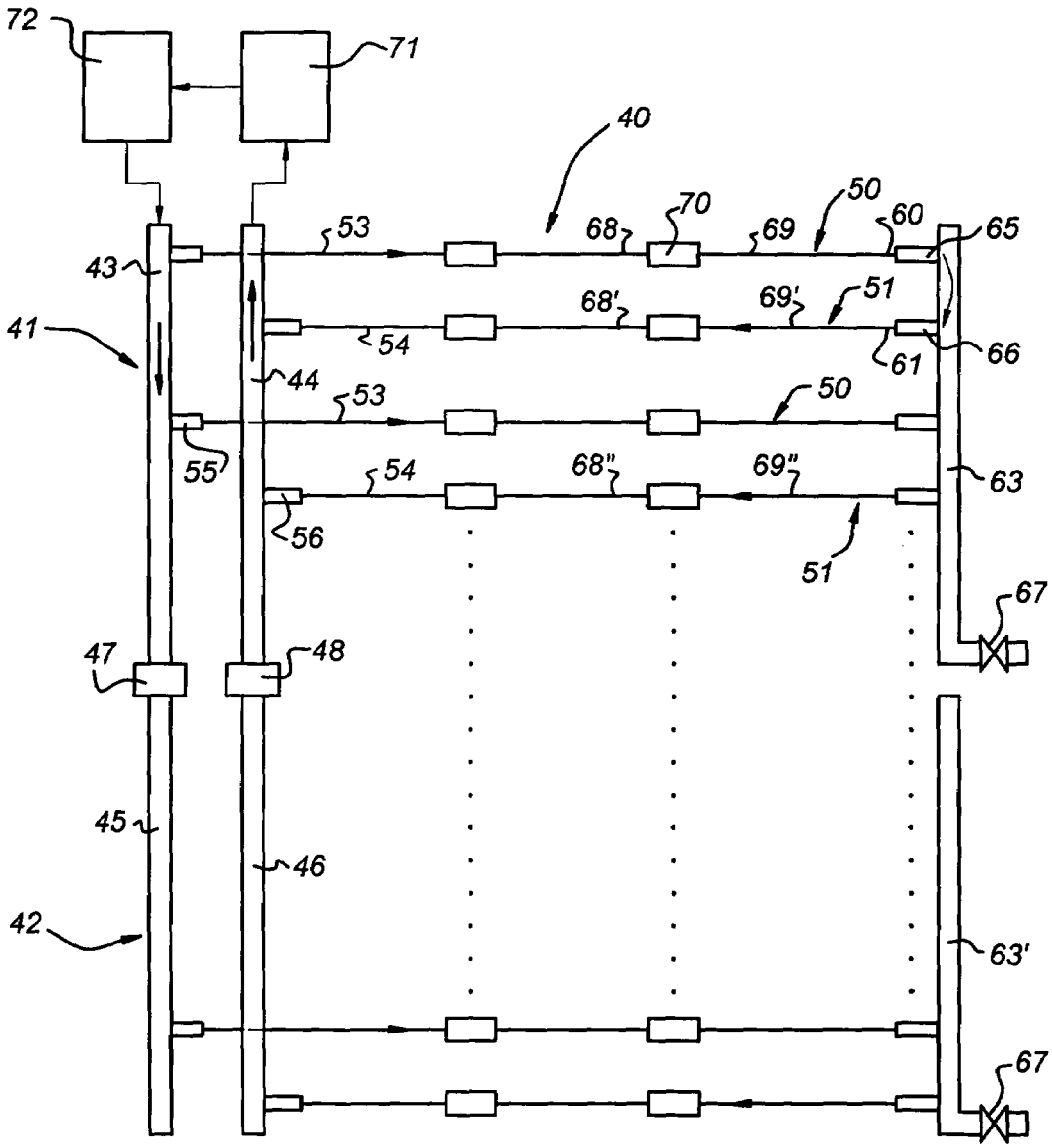
FIG. 8 shows a plan view of a cooling member according to the invention.

FIG. 8 shows a cooling member 40 according to the invention with two elements 41, 42. Each element 41, 42 is made up of a feed manifold, or header, 43, 45 and a discharge manifold 44, 46. The pipes 43, 45 and 44, 46 are connected to one another via a fluid-tight coupling member 47, 48. A number of longitudinal pipes 50, 51 are connected to each manifold 43–46. The feed pipes 50 are connected at the first end 53 thereof to the feed manifolds 43, 45 via connectors 55, such as a flexible tubular material. The return lines 51 are connected at the first end 54 thereof to the discharge manifolds 44, 46 via similar connectors 56. At their second end 60, 61, the longitudinal pipes 50, 51 are connected to a connecting pipe 63, via flexible tubular parts 65, 66. The connecting pipe 63, 63' is a single, rigid, hollow pipe and is provided with a vent tap 67, 67'.

Each longitudinal pipe 50, 51 is made up of a number of rigid and mutually parallel series of pipe sections 68, 68', 68"; 69, 69', 69" that are connected to one another in a fluid-tight manner via a joint member 70. The joint member 70 retains its fluid-tight connection between the pipe sections 68, 69 even when these have been placed in the transport position according to FIG. 2 or FIG. 3 and can comprise a flexible tube, a mechanical joint, a universal joint or similar elements.

Cooling liquid is fed from a reservoir 71 to a cooling element 72 and from there is fed to the feed manifolds 43, 45. The liquid passes through the feed pipes 50 from the manifolds 43, 45 to the connecting pipe 63 and there, as a consequence of the prevailing partial vacuum, will move along the return path shown by a broken line, via the neighbouring return pipes, 51, to the discharge manifolds 44, 46. With this arrangement the average temperature of the longitudinal feed pipes 50 and the return pipes 51 is virtually identical at every point. The decrease in temperature over the length of the longitudinal feed pipe 50 is compensated for by the reduction in temperature over the length of the neighbouring return pipes 51. With this arrangement an inlet temperature in the feed manifold 43, 45 can be, for example, −10° C., the temperature at the location of the connecting pipe 63 can be −8° C. and the temperature in the discharge manifolds 44, 46 can be −6° C., so that the average temperature of the longitudinal pipes 50, 51 at the manifolds is (−10+−6)/2=−8° C. The temperature at the connecting pipe 63, 63' is (−8+−8)/2=−8° C. The desired width of the ice rink can be obtained by varying the number of elements 41, 42, whilst the desired length is obtained by varying the number of pipe sections 68, 69 used. It is also possible to double the length of the ice rink by placing two cooling members 40 with their connecting pipes 63 next to one another, in the extension of one another.

FIG. 9 shows an assembly of a feed manifold 45 and a discharge manifold 46, which have been combined to give a portable, integrated unit 80. The manifolds 45, 46 have been fed through end plates 81, 82, which end plates are provided with hand grips 83, 84, by means of which the unit 80 can be lifted. The connectors 55, 56 are formed by tubular sections that protrude at a downward angle from the periphery of the pipes 45, 46 and that are connected to a flexible tube 86, 87, which, in turn, is connected to the rigid longitudinal pipes 50, 51. The end sections of the pipes 45, 46 are provided with a peripheral groove 88, 89 on which a coupling member 47, 48 can engage, as shown in FIG. 10 and FIG. 11.

As is shown in FIG. 10, two manifolds 43, 45 are connected to one another by placing these in a compression coupling 47, the top and bottom half 91, 92 being pressed against one another by operation of the clamp 90 running around the periphery. The compression coupling 47 can be provided on its internal surface with metal edges that drop into the peripheral grooves 89, 89' of the pipes 43, 45 to form a rigid mechanical joint. A fluid-tight seal against the outer periphery of the pipes 43, 45 is achieved with the aid of rubber seals 98, 99. The semicircular top and bottom of the compression coupling 47 which are joined to one another at a hinge point 93 and which can be hinged away from one another along a non-joined side 94, can be seen in side view in FIG. 11. The clamp 90 is joined by a lug 95 to the bottom part 92 such that it can pivot and, by placing in the position shown, pushes the top and bottom parts 91, 92 of the compression coupling 47 against one another.

FIG. 12 shows a view in the longitudinal direction of a basin 100 that has been formed from a sheet 102 that has been fed over raised side edges 103. A cooling member according to the invention with manifolds 104 coupled to one another has been placed in the basin 100. The manifolds 104 are supported some distance above the base of the basin via the end plates 105, 106. The connectors 108 are located below the top 109 of the manifolds 104, so that the manifolds 104, the connectors 108 and the longitudinal pipes 109 are located below the ice level 110. This can also be seen from the side view in the direction of the manifolds according to FIG. 13. Vertical uprights 111, 112, each of which is provided with a foot 113, 114, have been frozen into the ice.

In FIG. 14*a* it is indicated how the cooling liquid can be recovered from the cooling member when disassembling the ice rink according to the invention. For this purpose the vent tap 120 in the connecting pipe 121 is opened. The set of parallel pipe sections 122 bordering the connecting pipe 121 is then lifted up by operating joint member 126 and the liquid that flows towards the manifolds 119, 123 is fed via a membrane pump (that is relatively unaffected by air inclusion) to a collection basin 125. A prop 129 is then placed underneath the joint member 126, as shown in FIG. 14*b*, so that pipe sections 130 are emptied without cooling liquid flowing back into the pipe section 122. This operation is then repeated by placing the prop 129 underneath the joint locations 127, 128 until all cooling liquid has been collected in basin 125. The manifolds can then be uncoupled from one another and the manifolds 119, 123 and the pipe sections 122, 130 connected thereto can be placed in the transport position according to FIG. 2 or FIG. 3 and removed.

The invention claimed is:

1. A cooling member for a mobile ice rink, comprising:

two cooling elements (41, 42), each of said cooling elements having a feed manifold (43, 45) and a discharge manifold (44, 46) and plural longitudinal pipes (50, 51) extending transverse to said feed and discharge manifolds;

said plural longitudinal pipes having first ends (53, 54) connected to respective ones of said feed and discharge manifolds, respective pairs of said longitudinal pipes having second ends (60, 61) that are in fluid communication with each other through a connector (27, 63) so that a fluid path is formed from said feed manifold to said discharge manifold through said pairs of said longitudinal pipes that are connected by respective ones of said connector;

each of said plural longitudinal pipes comprising at least two rigid pipe sections (3, 12, 16, 24, 68, 69) that are connected to each other with a joint (4, 13, 17, 25, 70, 132, 133) that is fluid-tight both in an operational position with said at least two rigid pipe sections longitudinally aligned with each other and in a transport position with said at least two rigid pipe sections out of longitudinal alignment with each other at said joint, said at least two rigid pipe sections being foldably movable between said operational and transport positions; and fluid-tight coupling members (47, 48) that, in the operational position, join said feed manifold of one of said cooling elements to said feed manifold of another of said cooling elements and that join said discharge manifold of one of said cooling elements to said discharge manifold of another of said cooling elements.

2. The cooling member of claim 1, wherein said connector comprises a connecting pipe (63) to which said second ends of said longitudinal pipes are connected by a flexible pipe section (65, 66).

3. The cooling member of claim 2, wherein said feed manifold, said discharge manifold, and said connecting pipe are substantially parallel to one another.

4. The cooling member of claim 1, further comprising a spacer (26) that links said longitudinal pipes to each other.

5. The cooling member of claim 1, wherein said longitudinal pipes are lower than a top (109) of said feed and discharge manifolds, said fee and discharge manifolds being provided with openings and connectors (55, 56) for connection of said first ends (53, 54) of said longitudinal pipes, said first ends (53, 54) not protruding above said feed and discharge manifolds.

6. The cooling member of claim 1, wherein said joint comprises a flexible tube.

7. The cooling member of claim 6, wherein said flexible tube is made of ethylene propylene diene monomer (EPDM).

8. The cooling member of claim 1, wherein said joint is arranged and adapted so that said two rigid pipe sections joined by said joint are generally parallel with one atop the other in the transport position.

* * * * *

UNITED STATES PATENT AND TRADEMARK OFFICE

CERTIFICATE OF CORRECTION

PATENT NO. : 7,089,753 B2
APPLICATION NO. : 10/807251
DATED : August 15, 2006
INVENTOR(S) : Wilhelmus Adolfus Johannes Marie Hoeks It is certified that error appears in the above-identified patent and that said Letters Patent is hereby corrected as shown below:

Column 8
Line 43, delete "(41, 42)".
Line 44, delete "(43, 45)".
Line 45, delete "(44, 46)".
Line 46, delete "(50, 51)".
Line 48, delete "(53, 54)".
Line 51, delete "(60, 61)".
Line 52, delete "(27, 63)".
Line 58, delete "(3, 12, 16, 24, 68, 69)".
Line 59, delete "(4, 13, 17, 25, 70,".
Line 60, delete "132, 133)".

Column 9
Line 1, delete "(47, 48)".
Line 8, delete "(63)".
Line 10, delete "(65, 66)".
Line 15, delete "(26)".
Line 17, delete "(109)".

Column 10
Line 2, delete "(55, 56)".
Line 3, delete "(53, 54)".
Line 4, delete "(53, 54)".

Signed and Sealed this

Seventeenth Day of March, 2009

JOHN DOLL
*Acting Director of the United States Patent and Trademark Office*